US007955108B2

(12) United States Patent
Jonli et al.

(10) Patent No.: US 7,955,108 B2
(45) Date of Patent: Jun. 7, 2011

(54) CABLE END JOINT ASSEMBLY

(75) Inventors: Odd Magne Jonli, Ski (NO); Kare Asper, Fjellhamar (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/654,481

(22) Filed: Jan. 17, 2007

(65) Prior Publication Data

US 2007/0190839 A1 Aug. 16, 2007

(30) Foreign Application Priority Data

Jan. 18, 2006 (NO) ..... 20060271

(51) Int. Cl.
*H01R 13/52* (2006.01)

(52) U.S. Cl. ..... 439/274; 439/521; 174/74 A; 174/74 R; 174/76; 174/77 R

(58) Field of Classification Search ..... 439/521, 439/274; 174/74 A, 74 R, 76, 77 R, 84 R, 174/93
See application file for complete search history.

(56) References Cited

U.S. PATENT DOCUMENTS 3,504,099 A * 3/1970 Beinhaur ..... 174/72 R
3,614,295 A * 10/1971 Gillemot et al. ..... 174/87
3,710,003 A * 1/1973 Channell ..... 174/37
3,848,074 A * 11/1974 Channell ..... 174/38
3,919,460 A * 11/1975 Neail et al. ..... 174/87
4,039,742 A * 8/1977 Smith ..... 174/87
4,053,704 A * 10/1977 Smith ..... 174/87
4,500,151 A * 2/1985 Ayers ..... 439/586
4,721,832 A * 1/1988 Toy ..... 174/87
4,737,600 A * 4/1988 Mathis et al. ..... 174/87
4,877,943 A 10/1989 Oiwa ..... 219/538
4,963,698 A 10/1990 Chang et al. ..... 174/77 R
5,210,376 A * 5/1993 Caviar ..... 174/87
5,589,666 A * 12/1996 DeCarlo et al. ..... 174/87
5,859,388 A * 1/1999 Allen et al. ..... 174/77 R
6,730,847 B1 * 5/2004 Fitzgerald et al. ..... 174/77 R
2004/0219821 A1 * 11/2004 Makita et al. ..... 439/445

OTHER PUBLICATIONS

Norwegian Search Report—Aug. 21, 2006.

* cited by examiner

*Primary Examiner* — Tho D Ta
(74) *Attorney, Agent, or Firm* — Sofer & Haroun, LLP

(57) ABSTRACT

A cable end joint assembly (60) for a heating cable is provided, and a method for manufacturing of said joint assembly. The cable end joint assembly comprises at least two insulated conductors (11,12) arranged within a common sheath (10) and has end portions (1,2) stripped for their insulation (11,12) and electrically interconnected (3), as well as an enclosing end cap (6) being sealed to the sheath (10). The cable end joint assembly (60) further comprises at least one sealing element (4), which is provided between the respective conductor insulations (11,12) and the inner wall (26) of the end cap (6).

14 Claims, 2 Drawing Sheets

CABLE END JOINT ASSEMBLY

RELATED APPLICATION

This application is related to and claims the benefit of priority from Norwegian Patent Application No. 2006 0271, filed on Jan. 18, 2006, the entirety of which is incorporated herein by reference.

FIELD OF THE INVENTION

The present invention relates to a cable end joint assembly, in particular for heating cables and more particularly twin conductor heating cables having an end seal, where the two insulated conductors are connected and sealed off to form an electrical circuit and thus create a heating cable element.

BACKGROUND

Heating cables are commonly used in bathroom floors, where they are exposed to a very aggressive environment with high humidity and high values of pH.

The main problem with such heating cables is that humidity can enter the cable end from the inside. This may be due to a damage on the outer cable sheath or water from the outside (e.g. from surrounding concrete). Water that has penetrated to the cable end seal can create an electrical bridge between the phase conductor element and the earth screen or wire in the cable, and the product fails. Typically this will occur a short time after installation, and there may be large direct costs for repairing the damage.

It is also a tendency that the insulation of the resistance wire after some time with heat cycling will retract, with the consequence that the metal in the phase conductor element comes in direct contact with the earth wire. This is called "shrink-back of insulation" and is typically something that happens after the heating cable has been installed and has been operating for some time. The main reason for this is bad adherence between the conductor and the insulation (e.g. cross-linked polyethylene insulation) applied thereto.

It is known to use different techniques as e.g. combinations of: shrink sleeves, hot-melt glues, or shrink sleeves with glue combined with an end-cap welded to the cable outer sheath, to both insulate the end portions of the electrical conductors and to seal off the cable end against water penetration. Experience shows that this method is not always satisfactory. Water may in some cases penetrate the end seal and form an electrical bridge from the conductor connection to the earth wire.

Another prior solution comprises a shrink hose with glue as electrical insulation (giving an inner seal) and an end-cap, preferably of a PVC material, welded on to give an outer seal. However, this solution has weakness in that it is not waterproof in 100% of the cases. Some quality variations in the level of shrinking may occur. In addition the manufacturing process with a crimp hose and a PVC end-cap is very time-consuming, and relatively expensive parts are needed.

OBJECTS AND SUMMARY

Thus, the invention relates to a cable end joint assembly, in particular for a heating cable comprising at least two insulated conductors arranged, within a common sheath and having end portions stripped for their insulation and electrically interconnected, with an enclosing end-cap being sealed to the sheath.

What is novel and specific according to this invention is in the first place that a seal or a sealing element of a substantially elastomeric material is provided between the respective conductor insulations and the inner wall of the end-cap. Single seals or sealing elements can be used for each conductor, but since it is essential to keep end-cap dimensions to a minimum, it is an advantage to use one double seal for two conductors. The sealing element will provide protection for water penetration both along the surface of the conductors and along the surface of the outer cap that is preferably of a PVC material.

End sealing with a double seal together with an end-cap in a relatively rigid material, preferably PVC, seals off the inner end and the outer end. This solution will block for water even if the welding of the end-cap to the cable is not 100% waterproof.

Shrink-back of the insulation when pulled out of the seal would give free way for water to the end seal, creating a fault. Therefore a crimp connector making the electrical connection between the metallic conductors has such a form that it will also mechanically lock or fix the insulation of the conductors.

The end seal according to the invention will rely on the mechanical characteristics of the conductor insulation, the elastomeric (e.g. silicone rubber) seal and the polymeric end-cap (preferably of a PVC material).

BRIEF DESCRIPTION OF THE DRAWINGS

The invention will be further explained in the following description referring to the drawings, in which.

DETAILED DESCRIPTION

Figure 1:
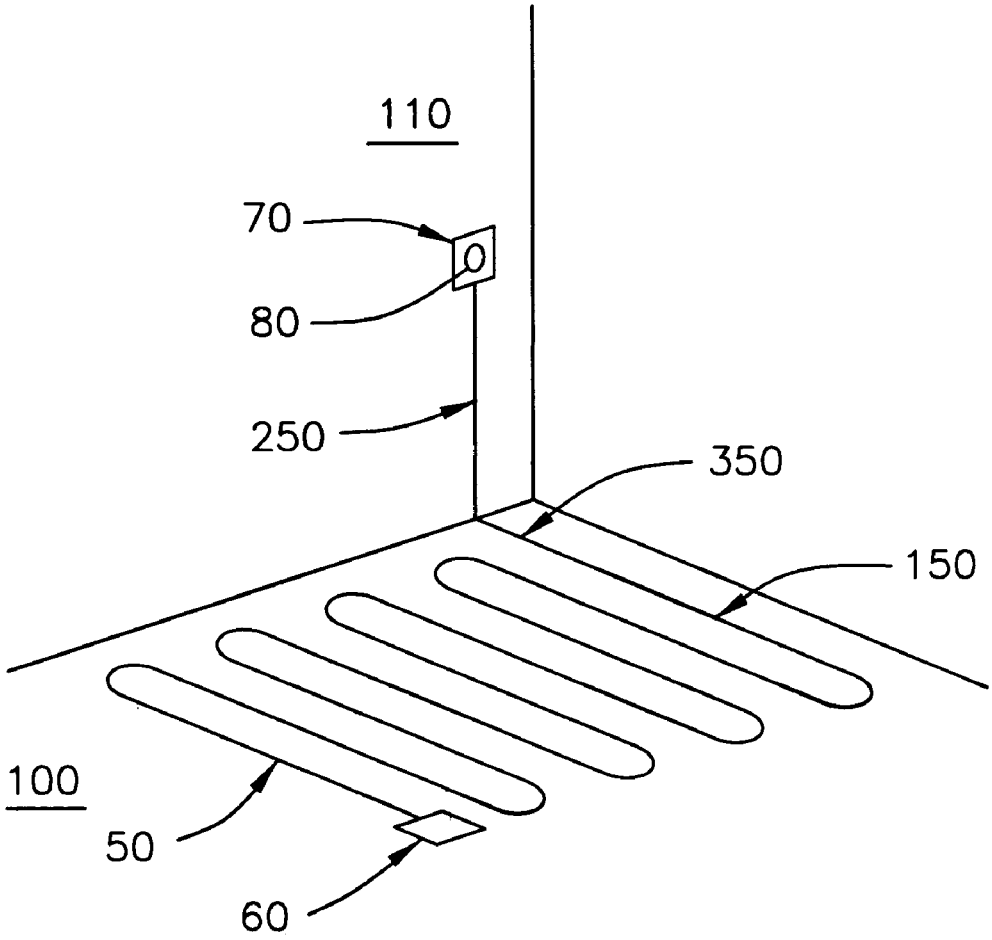
FIG. 1 shows the principle of an installed twin conductor heating cable arrangement on a floor ready to be embedded in a concrete slab.

FIG. 1 shows an installed twin conductor heating cable 50 which is arranged on a floor 100 ready to be embedded in a concrete slab. Such heating cables are commonly used in bathroom floors, where they are exposed to very aggressive environment conditions with relatively high humidity and high pH values. The heating cable 50 comprises a cold part 250 assembled in or on a wall 110, a hot part 150 embedded in the floor 100, a sliding point 350 between the hot 150 and cold 250 parts of the heating cable 50, and a cable end joint assembly 60 according to the present invention. The other end (i.e. the cold part 250 end) of the heating cable 50 is connected to a switch 70 with a thermostat 80, and further connected to a power supply (not shown). The switch 70 with the thermostat 80 can for example be assembled on the wall 110. The hot part 150 of the heating cable 50 is laid or placed on the floor 100 in a certain manner, so that the whole floor area or desired parts of it should be sufficiently covered.

Figure 2:
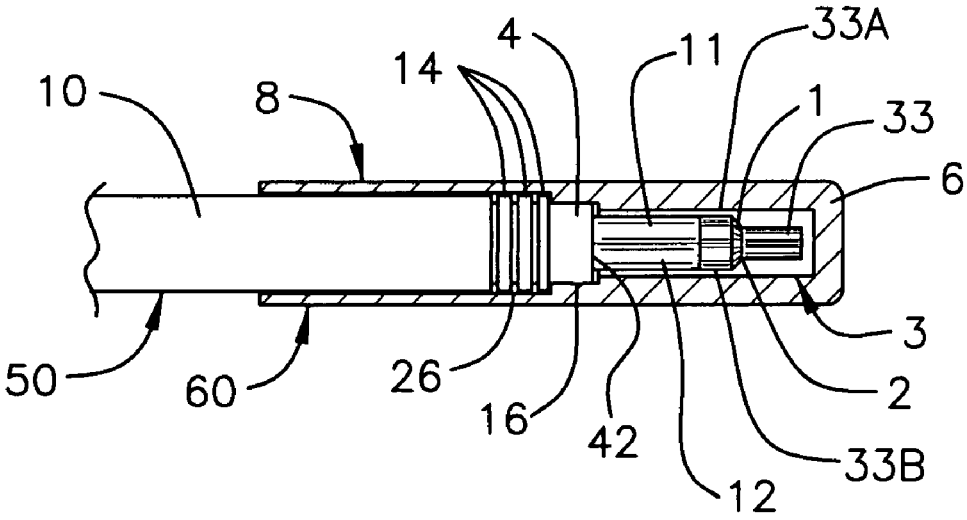
FIG. 2 shows a partial cross section of a preferred embodiment of the cable end joint assembly according to the invention.

On FIG. 2 a preferred embodiment of the cable end joint assembly 60 according to the invention is illustrated. The joint assembly 60 comprises the end part of a heating cable having at least two insulated conductors 11, 12 arranged within a common sheath 10 of the cable. The two insulated conductors 11, 12 can be arranged in parallel or stranded. The insulation 11, 12 of the conductors is being stripped forming non-insulated end portions 1, 2. The end portions 1, 2 of the two insulated conductors 11, 12 are electrically interconnected 3. An enclosing end cap 6 is being sealed 8 to the sheath 10. The cable end joint assembly 60 further comprises at least one sealing element 4 of a substantially elastomeric material, which sealing element 4 is provided between the respective conductor insulations 11, 12 and the inner wall 26 of the end cap 6 for preventing possible moisture from entering the cable end joint assembly area. In a preferred embodiment there is provided only one sealing element 4 (see FIG. 3). However it is also possible to have several sealing elements 4, for example one for each of the respective insulated conductors 11, 12.

The material of the enclosing end cap 6 should have good mechanical characteristics and also be sufficiently rigid in order to bear the compressive surrounding forces in the concrete. Therefore the elastomeric material of the sealing element 4 should be softer than the material of the enclosing end cap 6. The material of the sealing element 4 should have good elastomeric or elastic characteristics in order to establish a good sealing barrier and thus provide protection for water penetration both along the surface of the heating cable conductors and along the surface of the outer end cap 6 which is usually of a PVC material.

The heating cable usually has at least one earth wire (not shown) which is being cut where the common sheath 10 terminates. The earth wire is usually made of copper.

It is preferred that the sealing element 4 is provided with at least one outer sealing rib 14 abutting the inner wall 26 of the end cap 6, and the sealing element 4 also has an end face arranged to abut the common outer sheath 10. The outer sealing rib 14 can be rounded 44, at least on one side, in order to provide for easy mounting or threading of the enclosing end cap 6.

Generally the initial outer transverse dimensions of the sealing element 4 are larger than the corresponding interior transverse dimensions of the end cap 6, so that a highly efficient sealing barrier can be formed.

The enclosing end cap 6 can be provided with at least one internal stop edge surface 16 for cooperating with an outer end face 42 of the sealing element 4.

Figure 3:
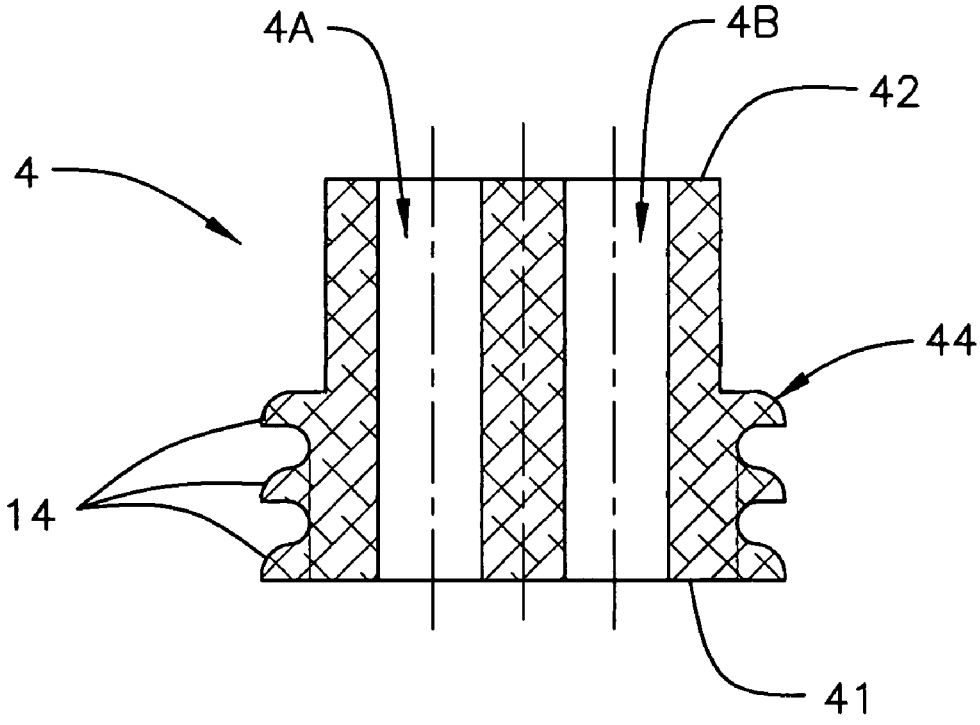
FIG. 3 shows a cross section of a preferred embodiment of the sealing element according to the invention.

FIG. 3 shows a cross section of a preferred embodiment of the sealing element 4 according to the invention, where there are provided individual apertures 4A, 4B for mounting or threading each of the two insulated conductors 11, 12 through its respective individual aperture 4A or 4B. After which the conductors 11, 12 have their end portions 1, 2 jointed 3 together (see below). The sealing element 4 preferably comprises sealing ribs 14, which are rounded 44 on the side for mounting or threading of the enclosing end cap 6.

Twin conductor heating cables have usually one resistance conductor and one "return" copper conductor. It is, however, possible to produce a heating cable with two resistance conductors.

Therefore, and also due to the fact that the manufactured wire for a heating cable having alternating lengths of copper and resistance conductors can be cut at different places, there are three possible variants for electrical interconnection: a) interconnection of two copper conductor ends 1, 2; b) interconnection of two resistance conductor ends 1, 2; and c) interconnection of one copper conductor end 1 and one resistance conductor end 2. The electrical interconnection in the cable end joint assembly forms the electrical circuit in the heating cable element, wherein the other end is connected to a power supply.

The two conductor end portions 1, 2 can be interconnected 3 by means of welding or any other method which is suitable for making a secure electrical connection between two wire conductors.

In a preferred embodiment the electrical interconnection 3 is made by means of a crimp connector 33 having in addition clamp portions 33A, 33B for mechanical locking of the conductor insulations 11, 12, thereby avoiding any shrink-bask thereof.

The process for manufacturing the cable end joint assembly according to the invention is well suited for automation. The process preferably comprises the following steps:

stripping of the common sheath 10, and (in any order):

stripping the insulation 11, 12 of the end portions 1, 2 of the insulated conductors 11, 12;

mounting or threading at least one sealing element 4 onto the end portions 1, 2 of the insulated conductors 11, 12;

and finally electrically interconnecting 3 the end portions 1, 2 of the conductors 11, 12; as well as mounting or threading an enclosing end cap 6 onto the outer sheath 10 at the cable end; and sealing the end cap 6 to the sheath 10.

There are different possibilities for sealing the end cap 6 to the sheath 10, such as warm sealing, sealing with ultrasound or other suitable sealing processes.

It is appropriate to cut the earth wire(s) where the common sheath 10 terminates, before the step of mounting the sealing element 4.

While the foregoing description, with enclosed drawings, is directed to the preferred embodiments of the invention, various modifications will be apparent to those skilled in the art. It is intended that all variations within the scope and spirit of the appended claims shall be embraced by the foregoing disclosure.

What is claimed is:

1. Cable end joint assembly of a heating cable comprising:

at least two insulated conductors arranged within a common sheath and having end portions stripped for their insulation and electrically interconnected; and a single-piece enclosing end cap being directly sealed to said common sheath, wherein the cable end joint assembly further comprises at least one sealing element of a substantially elastomeric material, wherein said at least one sealing element is provided between said conductor insulations and the inner wall of said end cap.

2. Assembly according to claim 1, wherein said elastomeric material of the sealing element is softer than the material of the enclosing end cap.

3. Assembly according to claim 1, wherein an end face of said sealing element is arranged to abut said common sheath.

4. Assembly according to claim 1, wherein the sealing element is provided with individual apertures for each of the insulated conductors.

5. Assembly according to claim 1, wherein said end portions of said conductors are copper wires.

6. Assembly according to claim 1, wherein the two conductor ends are resistance wires.

7. Assembly according to claim 1, wherein one of the conductor end portions belongs to a copper wire and the other end portion belongs to a resistance wire.

8. Assembly according to claim 1, wherein the sealing element is provided with at least one outer sealing rib abutting the inner wall of the end cap.

9. Assembly according to claim 1, wherein the initial outer transverse dimensions of the sealing element are larger than the corresponding interior transverse dimensions of the end cap at said inner wall.

10. Assembly according to claim 8, wherein said at least one outer sealing rib is rounded for easy mounting or threading of the enclosing end cap.

11. Assembly according to claim 1, wherein the end cap is provided with an internal stop for cooperating with an outer end face of the sealing element.

12. Assembly according to claim 1, wherein the cable has at least one earth wire being cut off adjacent to the point where the common sheath is terminated.

13. Assembly according to claim 1, wherein the electrical interconnection is made by means of a crimp connector having clamp portions for mechanical locking of the conductor insulations.

14. Assembly according to claim 1, wherein said at least two insulated conductors are arranged in parallel.

* * * * *